United States Patent [19]

Lipinski et al.

[11] 4,201,681

[45] May 6, 1980

[54] METALWORKING CORROSION INHIBITION/DRAWING LUBRICANT

[75] Inventors: Henry F. Lipinski, Glenshaw, Pa.; Steven J. Wantling, Miami, Fla.

[73] Assignee: Exxon Research & Engineering Co., Florham Park, N.J.

[21] Appl. No.: 23,629

[22] Filed: Mar. 26, 1979

Related U.S. Application Data

[63] Continuation of Ser. No. 838,854, Oct. 3, 1977, abandoned.

[51] Int. Cl.[2] ..... C01M 1/40; C10M 3/34; C10M 5/22; B21B 45/02

[52] U.S. Cl. ..... 252/33.2; 72/42; 252/39; 252/389 R

[58] Field of Search ..... 252/33.2, 39, 389 R; 72/42

[56] References Cited

U.S. PATENT DOCUMENTS

| | | | |
|---|---|---|---|
| 2,610,946 | 9/1952 | Eckert | 252/33.2 |
| 2,719,826 | 10/1955 | Hotten | 252/18 |
| 3,019,190 | 1/1962 | Holzinger | 252/33.2 |
| 3,836,467 | 9/1974 | Jones | 252/18 |
| 3,984,599 | 10/1976 | Norton | 252/33.4 |

FOREIGN PATENT DOCUMENTS

| | | |
|---|---|---|
| 586669 | 3/1947 | United Kingdom . |
| 1189338 | 4/1970 | United Kingdom . |

OTHER PUBLICATIONS

Preliminary Data Sheet, Rein-Chemie Rheinau GmbH, Jul., 1976.

*Primary Examiner*—Irving Vaughn
*Attorney, Agent, or Firm*—Eugene Zagarella, Jr.

[57] ABSTRACT

A metalworking lubricant composition which is effective as both a corrosion inhibitor and drawing lubricant and comprises a mineral oil and an additive combination of barium lanolate soap and barium sulfonate.

16 Claims, No Drawings

METALWORKING CORROSION INHIBITION/DRAWING LUBRICANT

This is a continuation, of application Ser. No. 838,854, filed Oct. 3, 1977, abandoned.

BACKGROUND OF THE INVENTION

This invention relates to metalworking lubricants and to a process employing such lubricants and is especially concerned with lubricants which provide the dual function of corrosion protection as well as good drawing characteristics.

The desirability of providing corrosion and rust protection and drawability is well recognized in the metalworking art. However, the ability to satisfy both functions in one composition has not been easily attained since they represent somewhat contradictory or opposing technologies. Problems with regard to stability, compatability and relative effectiveness for the combined functions have made it difficult to attain suitable lubricant compositions.

SUMMARY OF THE INVENTION

It has now been found that the foregoing and other disadvantages of the prior art can be overcome by the lubricant composition of this invention which comprises a mineral oil and an additive combination of barium lanolate soap and barium sulfonate.

It is then an object of this invention to provide a metalworking lubricant composition which provides both corrosion protection and good drawing characteristics.

It is another object of this invention to provide metalworking lubricants which are storage stable and particularly effective in inhibiting corrosion and providing good drawability characteristics.

It is still a further object of this invention to provide a method for protecting rolled steel strip from corrosion, rust and stain and also provide good drawing properties.

Other objects of this invention will in part appear hereinafter and will in part be obvious.

These and other objects are accomplished with a metalworking lubricant composition containing a major amount of mineral oil and an effective amount of barium lanolate soap and barium sulfonate.

DETAILED DESCRIPTION OF THE INVENTION

The compositions of this invention contain a major proportion of a conventional lubricating oil, and most preferably a mineral oil.

The mineral oils useful in the composition of this invention will generally have a viscosity of at least about 40 SUS up to about 600 SUS at 100° F. (37.7° C.). More particularly the mineral oils will have a viscosity of from about 40 SUS to about 350 SUS at 100° F. (37.7° C.) and preferably from about 75 to about 150 SUS at 100° F. (37.7° C.).

The mineral oils can vary widely in refinement and they can be derived from a variety of crudes including paraffinic, naphthenic, asphaltic or mixed base. The mineral oils can be treated by any of the conventional refining methods including hydrogen treating, acid treating, extraction, etc. and blends or mixtures of such mineral oils can also be used. Paraffinic oils are particularly preferred.

In accordance with the invention, the compositions contain barium lanolate. Barium lanolate can be obtained by any known method and is generally obtained by reacting an inorganic barium donor compound with wool grease fatty acids. The barium donor compound is generally selected from the group consisting of barium hydroxide, barium oxide and barium carbonate with the hydroxide being particularly preferred.

While the barium lanolate can be obtained by any of the known methods as described above, it has been found that a particularly effective composition having good long range stability is obtained when the lanolate is prepared in a certain manner. This procedure involves the in situ formation wherein the wool grease fatty acids is reacted with barium hydroxide octahydrate in the presence of a small amount of lubricating oil at ambient temperature. The formed soap is then dehydrated by heating and the lubricating oil component added slowly with stirring followed by addition of the barium sulfonate component. This particularly prepared barium lanolate formulation had good anticorrosion, anti-stain and drawability properties and also is stable over an extended period of time.

Barium sulfonate is used in the composition of this invention and such component will generally be a synthetic sulfonate derived from an oil soluble sulfonic acid having the formula $RSO_3H$ wherein the R group may be alkyl, aryl and alkaryl. Generally, such sulfonic acids will have molecular weights of from about 200 to about 2500 and preferably from about 300 to about 700. Particularly preferred sulfonates are those having an alkaryl group, e.g., alkylated benzene or alkylated naphthalene. Illustrative examples of such sulfonic acids are dioctyl benzene sulfonic acid, didodecyl benzene sulfonic acid, dinonyl naphthalene sulfonic acid, dilauryl benzene sulfonic acid, lauryl cetyl benzene sulfonic acid, polyolefin alkylated benzene sulfonic acids such as polybutylene alkylated benzene sulfonic acid and polypropylene alkylated benzene sulfonic acid.

Generally, the lubricating mineral oil will form from about 70 to about 95, preferably about 80 to about 90 weight percent of the total composition. The barium lanolate soap will generally comprise from about 1 to about 10 and preferably from about 1.5 to about 3 weight percent and the barium sulfonate will comprise from about 5 to about 15 and preferably from about 8 to about 10 weight percent of the total lubricant composition.

The compositions of this invention may be formed by adding the barium lanolate to the oil mixture while stirring and then adding in the barium sulfonate component. As indicated earlier, a preferred method of preparation is by forming the barium lanolate in situ through the reaction of barium hydroxide octahydrate with wool grease fatty acids.

The compositions of this invention exhibit good corrosion, rust and stain protection while at the same time provide good drawing characteristics as well as protection of metal surfaces from scoring or galling as they are processed.

The following examples are further illustrative of this invention and are not intended to be construed as limitations thereof.

EXAMPLE I

A barium lanolate soap was made in situ by reacting 1.7 parts by weight of wool grease fatty acids with 0.5 part by weight of barium hydroxide octahydrate in the presence of a small amount of mineral oil at ambient temperature (approximately 70° F., 21° C.). The formed soap was then heated to 250° F. (121° C.) and held at this temperature until dehydration of the soap occurred at which point the dehydrated neutral soap was gradually contacted with 89.4 parts by weight of an oil mixture of a light mineral oil, Faxam 40 (73.2% by weight) and a paraffinic oil, Mentor 28 (26.8% by weight) with stirring. The heat was turned off and the gradual addition of the oil was used as a cool down mechanism. After the oil component was thoroughly stirred into the soap component and a homogeneous mixture resulted 8.4 parts by weight of barium didodecyl benzene sulfonate was added with stirring and the final formulation was as follows:

| | |
|---|---|
| Faxam 40 Mineral Oil | 65.4% by weight |
| Mentor 28 Paraffinic Oil | 23.9% by weight |
| Barium Lanolate Soap | 2.3% weight |
| Barium Didodecyl Benzene Sulfonate | 8.4% by weight |

The above prepared formulation was clear and had a viscosity of 95–105 SUS at 100° F. (37.7° C.), a flash point of 300° F. (149° C.) min and a sulfated ash weight percent of 1.1–1.5. Also of significance, this formulation remained stable and homogeneous for an extended period of over one year.

The lubricant composition prepared above was coated on steel strips which were processed in a forming operation and subsequently tested for corrosion, stain and drawing properties using standard tests including the Cleveland Q-Panel Test (Humidity Cabinet), the stack test for stain and friction measurements as well as visual observation for galling and scoring. The results of these tests showed the lubricant composition to be suitable for the protection of the metal to which it was applied gainst both corrosion and stain and additionally showed excellent drawing properties.

EXAMPLE II

A lubricant composition was prepared by slowly adding 65.6 parts by weight of Faxam 40 mineral oil to 2.0 parts by weight of barium lanolate with stirring. This was followed by the addition of 24.0 parts by weight of Mentor 28 paraffinic oil and 8.4 parts by weight of barium didodecyl benzene sulfonate with continued stirring and the final formulation was as follows:

| | |
|---|---|
| Faxam 40 Mineral Oil | 65.6% by weight |
| Mentor 28 Paraffinic Oil | 24.0% by weight |
| Barium Lanolate | 2.0% by weight |
| Barium Didodecyl Benzene Sulfonate | 8.4% by weight |

This formulation was applied to steel strips and passed the standard tests for corrosion and stain and exhibited satisfactory drawing characteristics in a manner similar to that described above in Example I. This formulation unlike the formulation of Example I was slightly cloudy after being prepared and showed evidence of separation after three weeks of static storage.

What is claimed is:

1. A metalworking corrosion inhibitor/drawing lubricant composition comprising a major amount of mineral oil and an effective amount of an additive combination of barium lanolate soap and barium sulfonate wherein said barium lanolate soap is formed in situ by reacting barium hydroxide with wool grease fatty acids.

2. The composition of claim 1 wherein from about 1 to about 10% by weight of said barium lanolate is used, said weight based on the total weight of lubricant composition.

3. The composition of claim 2 wherein from about 5 to about 15% by weight of said barium sulfonate is used, said weight based on the total weight of the lubricant composition.

4. The composition of claim 3 wherein said sulfonate is a synthetic barium hydrocarbon sulfonate derived from an oil-soluble sulfonic acid having the formula $RSO_3H$ wherein the R group may be alkyl, aryl or alkaryl.

5. The composition of claim 2 wherein said barium lanolate soap is initially formed in situ in the presence of a small amount of mineral oil followed by the addition of additional mineral oil and the barium sulfonate component.

6. The composition of claim 5 wherein said barium lanolate is formed by reacting barium hydroxide octahydrate with wool grease fatty acids.

7. The composition of claim 4 wherein said mineral oil has a viscosity of from about 40 to about 600 SUS at 100° F.

8. The composition of claim 7 wherein said sulfonic acid has a molecular weight of from about 200 to about 2500.

9. The composition of claim 8 wherein said barium lanolate is formed in situ by reacting barium hydroxide octahydrate with wool grease fatty acids.

10. The composition of claim 9 wherein from about 1.5 to about 3% by weight of said barium lanolate and from about 8 to about 10% by weight of said barium sulfonate is used.

11. The composition of claim 10 wherein said sulfonic acid has a molecular weight of from about 300 to about 700.

12. The composition of claim 11 wherein the R group in said sulfonic acid is an alkaryl group.

13. The composition of claim 12 wherein said barium sulfonate is barium didodecyl benzene sulfonate.

14. In the method of fabricating articles from steel strip the improvement which comprises the step of coating said steel strip with the lubricant composition of claim 1.

15. In the method of fabricating articles from steel strip the improvement which comprises the step of coating said steel strip with the lubricant composition of claim 9.

16. The composition of claim 9 wherein said barium lanolate soap is initially formed in situ in the presence of a small amount of mineral oil followed by the addition of additional mineral oil and the barium sulfonate component.

* * * * *